US006230759B1

(12) United States Patent
Shaw et al.

(10) Patent No.: US 6,230,759 B1
(45) Date of Patent: May 15, 2001

(54) GRIPPER WEAVING MACHINE WITH RIBBED GUIDE PORTON CONNECTED TO RAPIER

(75) Inventors: Henry Shaw, Steenvoorde (FR); Joost Carpentier, Moorslede; Lucien Coopman, Zonnebeke, both of (BE)

(73) Assignee: Picanol N.V. (BE)

( * ) Notice: Subject to any disclaimer, the term of this patent is extended or adjusted under 35 U.S.C. 154(b) by 0 days.

(21) Appl. No.: 09/381,967

(22) PCT Filed: Mar. 9, 1998

(86) PCT No.: PCT/EP98/01360

§ 371 Date: Jan. 3, 2000

§ 102(e) Date: Jan. 3, 2000

(87) PCT Pub. No.: WO98/44180

PCT Pub. Date: Oct. 8, 1998

(30) Foreign Application Priority Data

Apr. 2, 1997 (DE) ..... 197 13 628

(51) Int. Cl.[7] ..... D03D 47/27

(52) U.S. Cl. ..... 139/449

(58) Field of Search ..... 139/449

(56) References Cited

U.S. PATENT DOCUMENTS

| | | | | |
|---|---|---|---|---|
| 2,125,894 | * | 9/1938 | Dewas | 139/449 |
| 2,151,085 | * | 3/1939 | Dewas | 139/449 |
| 3,299,911 | * | 1/1967 | Dewas | 139/449 |
| 4,834,146 | * | 5/1989 | Pezzoli | 139/449 |
| 5,092,374 | * | 3/1992 | Riolet et al. | 139/449 |
| 5,813,440 | * | 9/1998 | Bortoli et al. | 139/449 |

* cited by examiner

*Primary Examiner*—Andy Falik
(74) *Attorney, Agent, or Firm*—Bacon & Thomas PLLC

(57) ABSTRACT

A gripper weaving machine with at least one gripper (1, 2) joined by a guide portion (21) to a rapier (3, 4) and fitted with guide units (19) arranged in a row and insertable into a formed shed (22). The guide portion (21) on its side facing away from the gripper (1) includes at least one slide rib (26) extending along the longitudinal direction of the guide portion and protects the warps (24) from making contact with the guide portion (21).

11 Claims, 7 Drawing Sheets

1
3
21
26
27
31
32
33
34
37

GRIPPER WEAVING MACHINE WITH RIBBED GUIDE PORTON CONNECTED TO RAPIER

BACKGROUND OF THE INVENTION

1. Field of the Invention

The invention relates to a gripper weaving machine comprising at least one gripper mounted by a guide portion to a rapier, further comprising guide units arranged in a row and insertable into an open shed and fitted with guides guiding the rapier and the guide portion.

2. Background of the Invention

A gripper weaving machine of the above type is known for example from the European patent document A1 0,576, 854. The guide units are fitted with guide elements which are associated with the top and bottom sides of the rapier and to the upper sides and undersides of the guide portion that are flush with said top and bottom sides. At least one guide rib is provided at the guide portion and is associated with a transverse guide of the guide units. Accordingly transverse guidance takes place only in the region of the guide portion, the rapier per se being of uniform and substantially rectangular cross-section. Accordingly the rapier is designed to be comparatively flexible in the direction of is its flat sides while being relatively stiff transversely. This design is possible because the transverse guidance is provided by the guide portion.

Desirably the speed of operation is increased in gripper weaving machines of the this type, in particular the filling frequency. This filling frequency can be raised when the shed that just received the filling is already closing before the gripper(s) has (have) been fully withdrawn from it.

SUMMARY OF THE INVENTION

The objective of the invention is to design a gripper weaving machine so that shed closure before full gripper withdrawal will be as free as possible of malfunction.

This problem is solved in that the guide portion at its side facing away from the gripper is fitted with at least one slide rib running in the longitudinal direction of the guide portion that protects the warps against contact with the guide portion.

When closing the shed before the gripper has been fully withdrawn from it, the minimum of one slide rib prevents warps from coming into contact with the guide portion, thereby assuring in the first place that the warps will not damage the typically plastic guide portion, in particular its guidance surfaces and, on the other hand, avoiding damaging or tangling the warps by the wear-susceptible guidance surfaces of the guide portion.

To carry out the invention, at least one slide rib is provided at the guide portion and/or the gripper, as an extension of this gripper and extending in the direction of the rapier. The rib protects the warps against making contact with the guide portion. Typically the gripper is made of a metal having a comparatively low coefficient of friction relative to the warps. The gripper projects beyond the guide portion so that warps resting against it will not touch the guide portion. This effect is maintained over the entire length of the guide portion when the slide rib is present, and accordingly the danger of damaging the guide portion and/or the warps is substantially reduced in this region.

Further features and advantages of the invention will be made evident from the following description of the embodiments shown in the drawings and from the appended claims.

Figure 2:
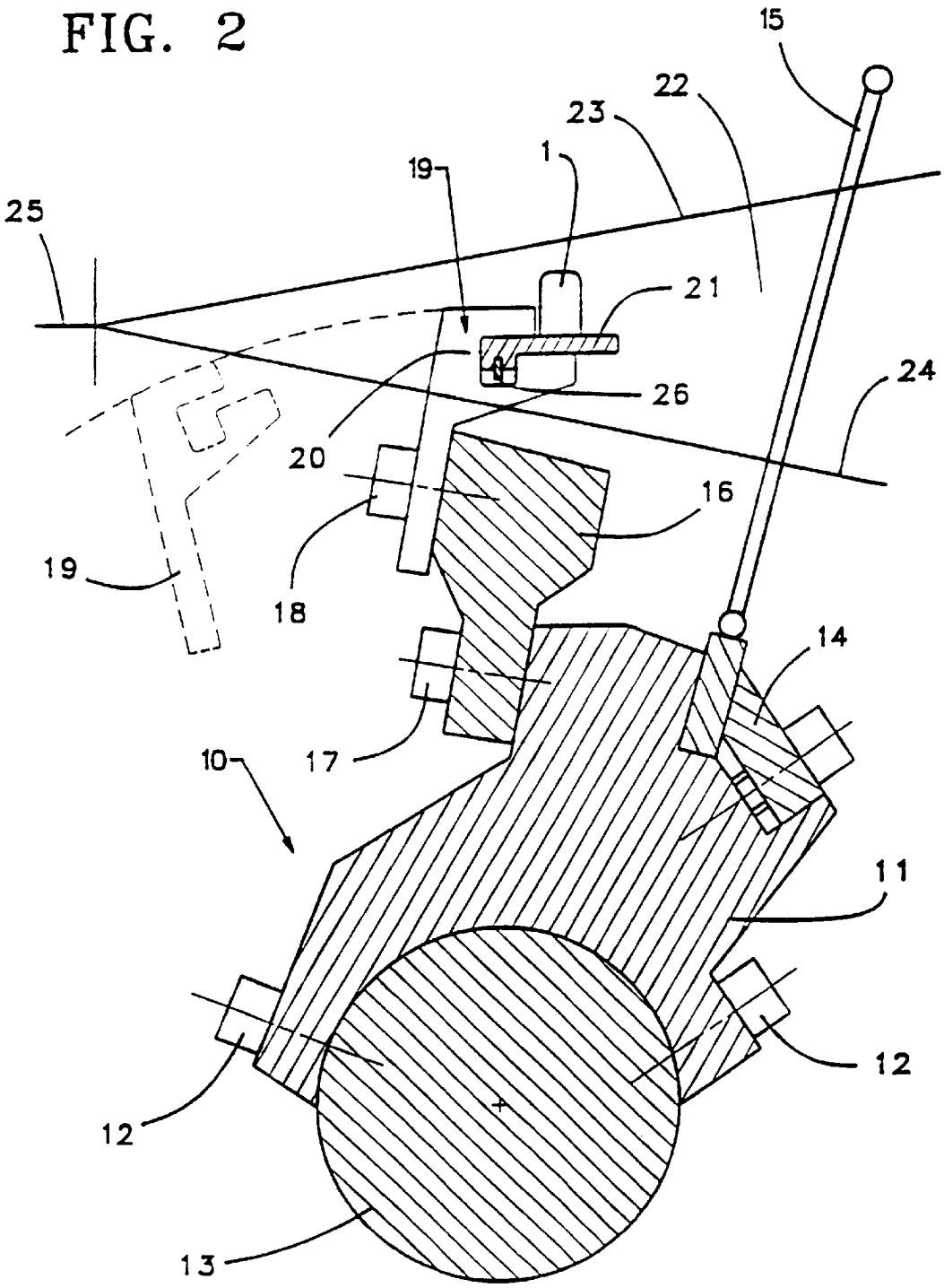
FIG. 2 shows a section along line II—II of FIG. 1 on a larger scale.
Figure 3:
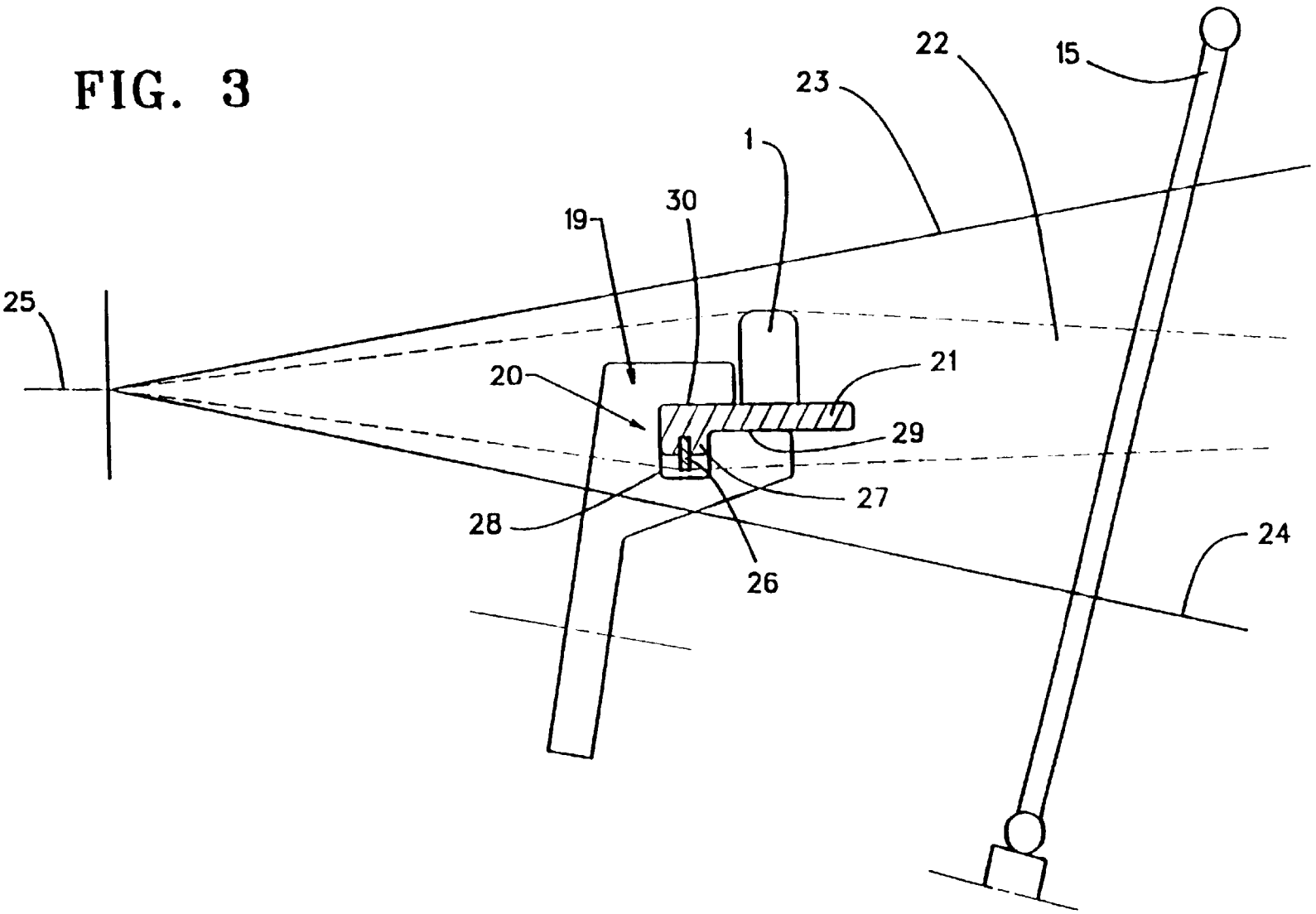
Figures 4, 5, 7, 9:
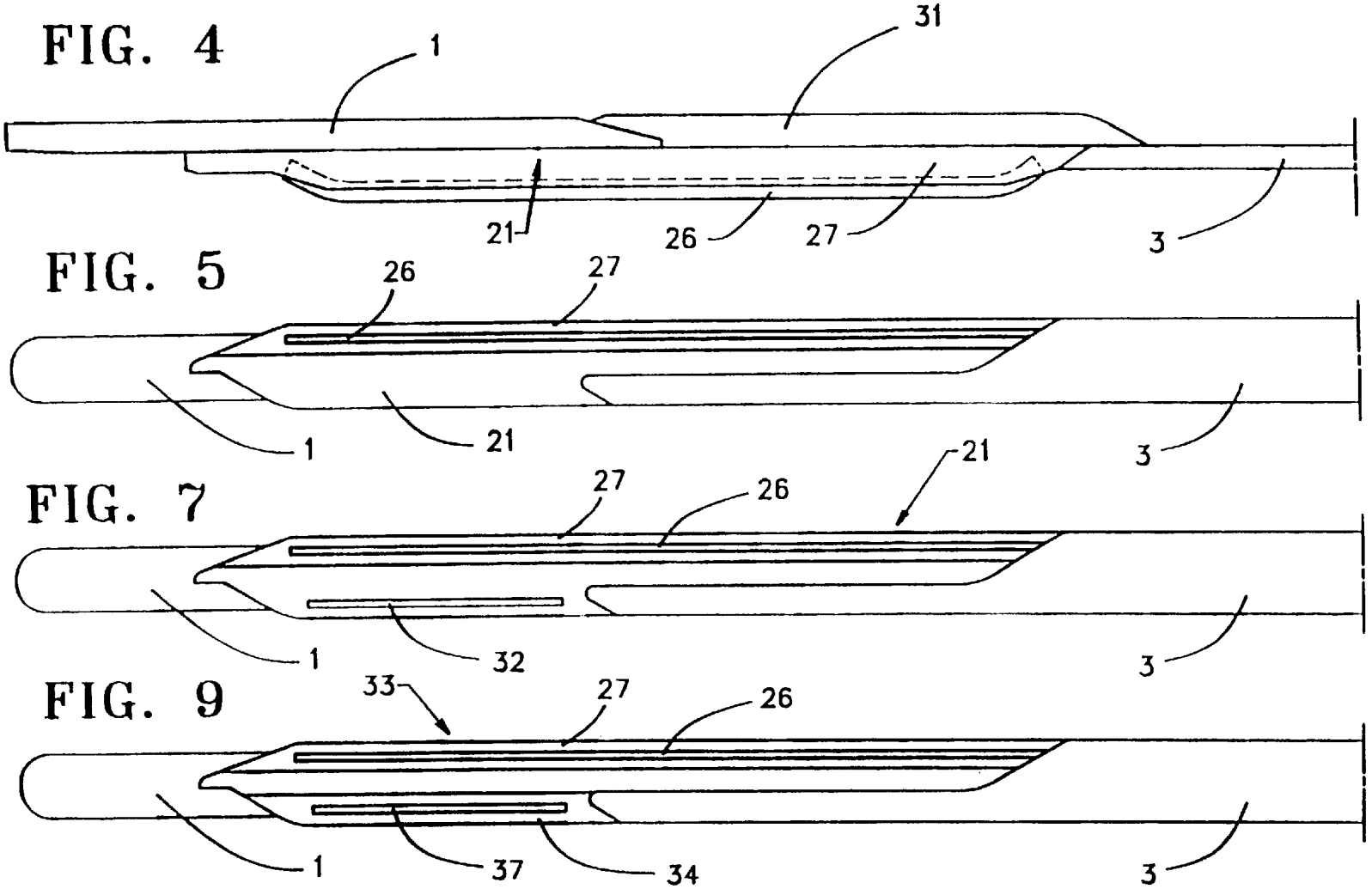
Figure 6:
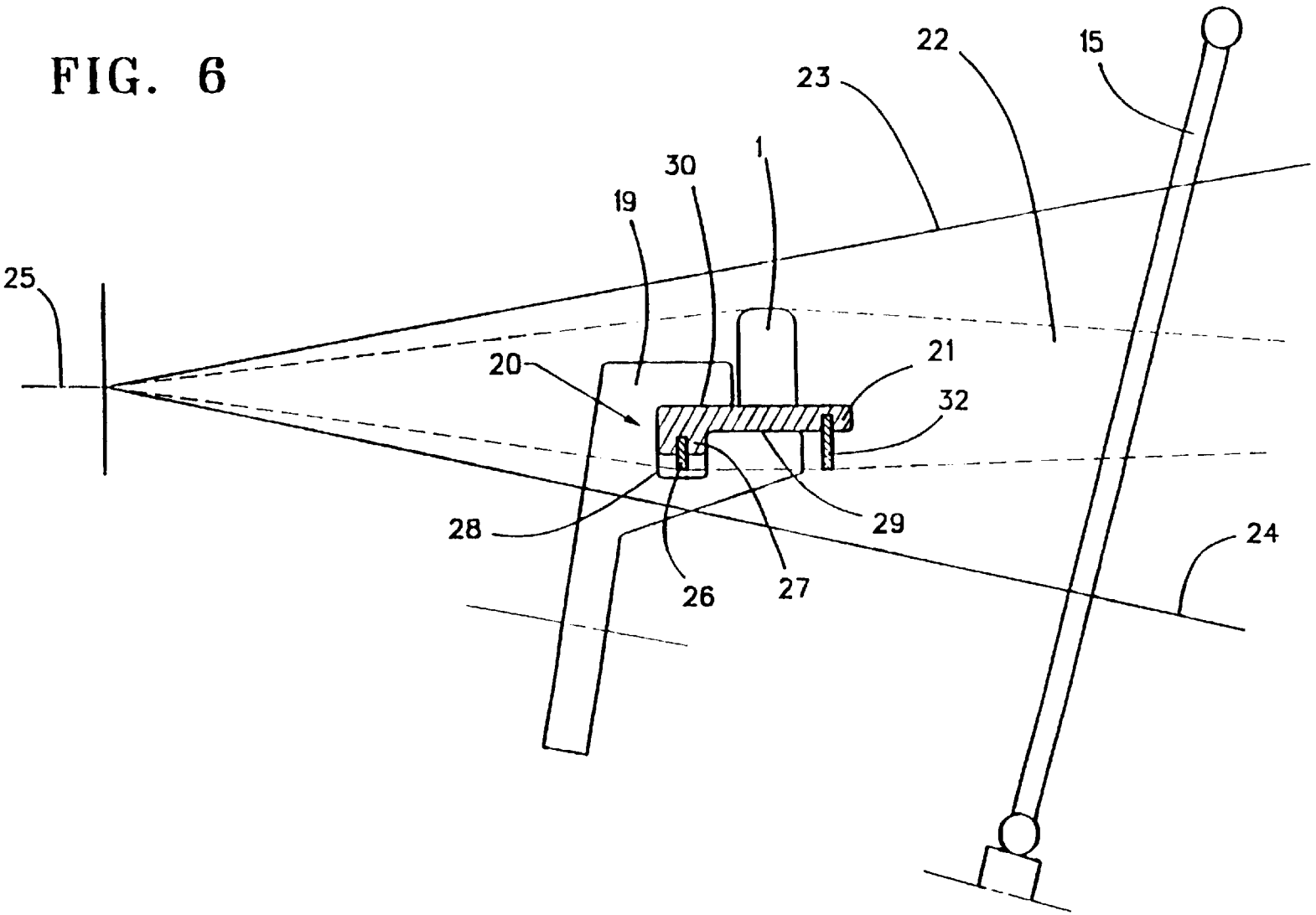
Figure 8:
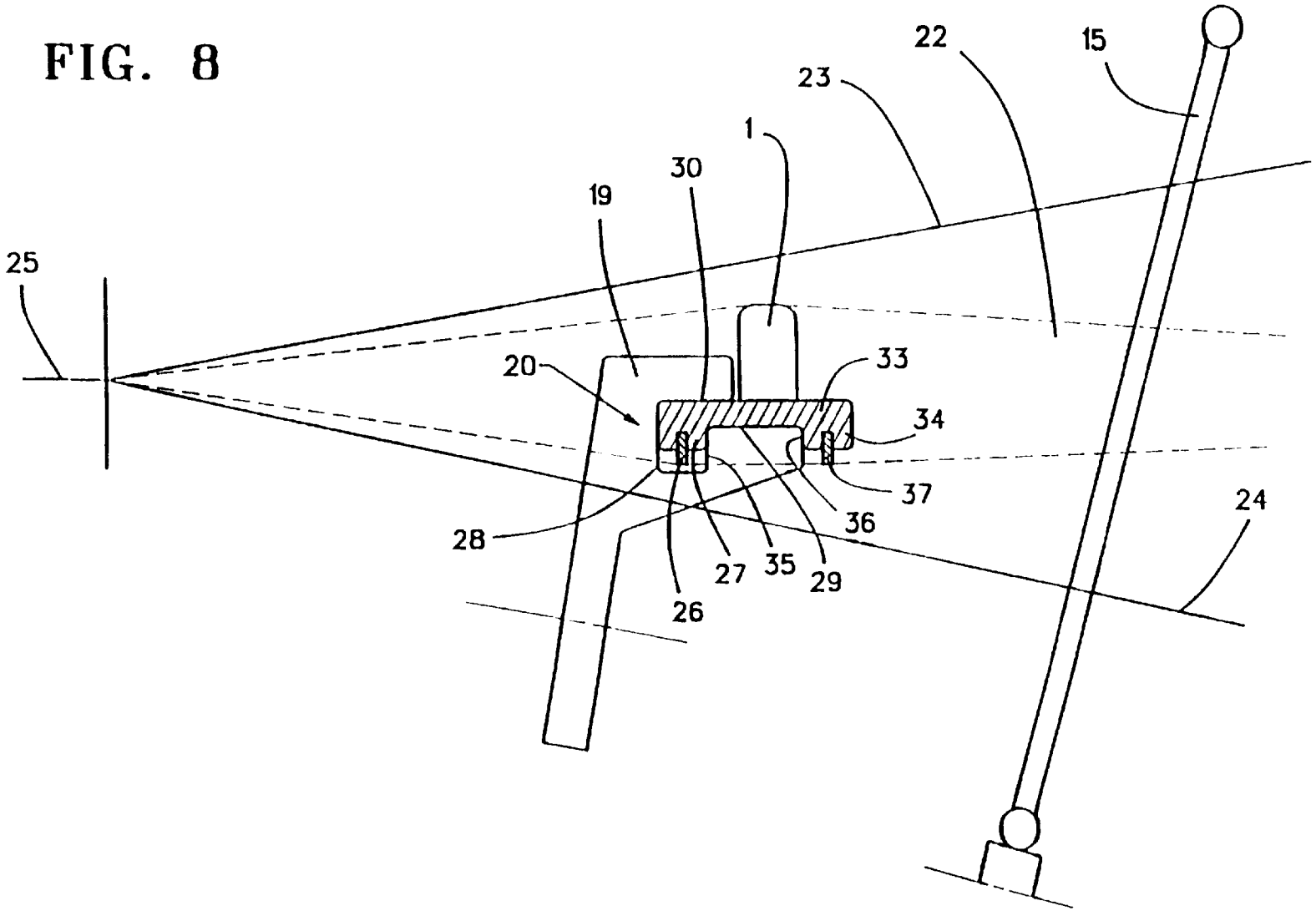
Figure 10:
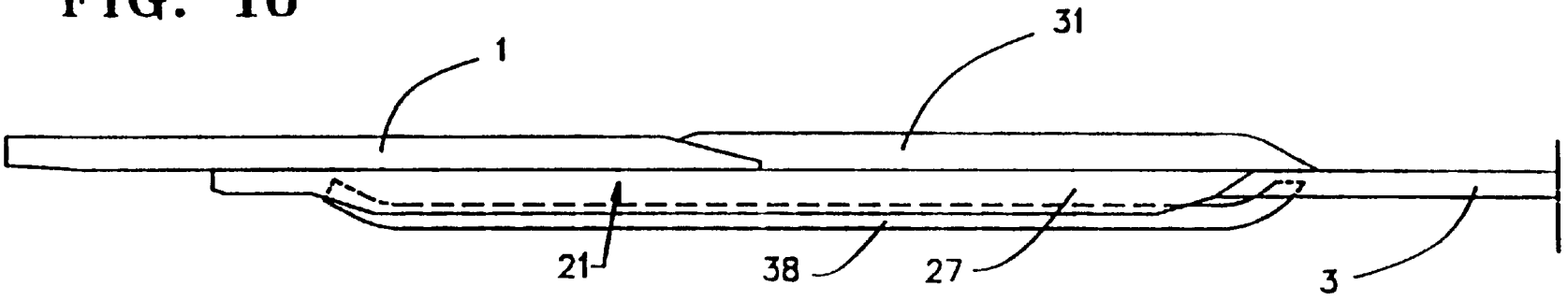
Figure 11:
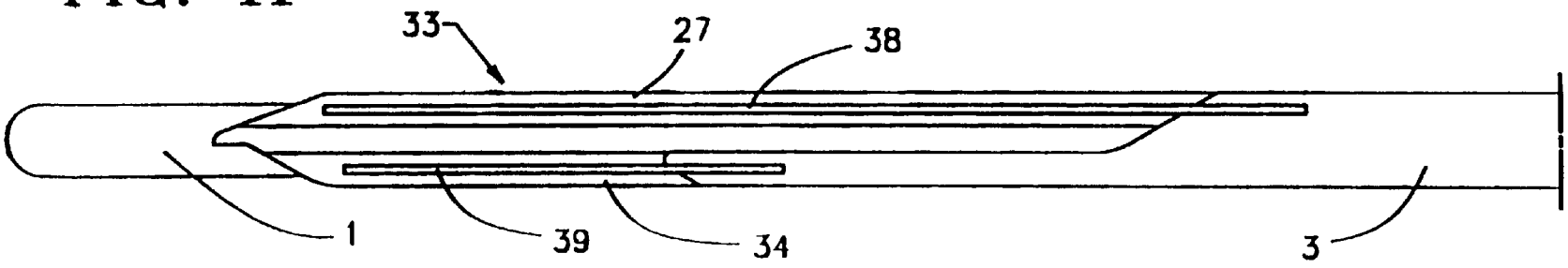

FIG. 3 is a section similar to that of FIG. 2 on a still larger scale, the shed already having partly closed while the gripper has not yet been fully withdrawn from it, FIG. 4 is a schematic side view of the gripper with a guide portion and slide ribs, FIG. 5 is a bottom view of the embodiment of FIG. 4, FIG. 6 is a section similar to that of Fig.3 of an embodiment with another guidance-part, FIG. 7 is a bottom view (on a smaller scale) of the guide portion of FIG. 5, and of the adjoining rapier and gripper, FIG. 8 is a section similar to FIG. 3 of another embodiment, FIG. 9 is a bottom view of the guide portion of FIG. 8 and the adjoining rapier with the gripper projecting beyond this rapier, and FIGS. 10, 11 are a sideview and a view from below of a guide portion showing the slide ribs extending into the front zone of the rapier.

Figure 1:
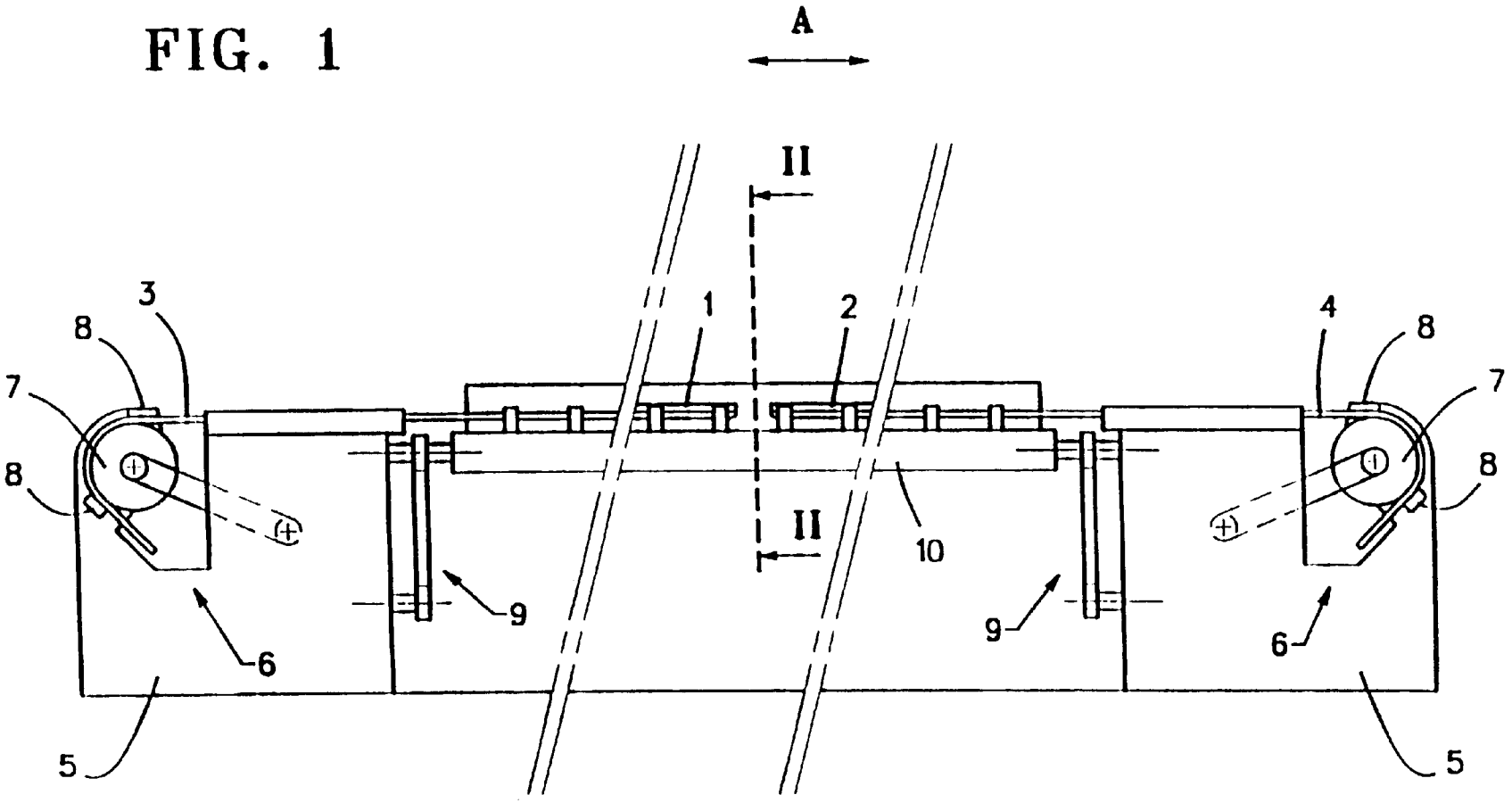
FIG. 1 is a schematic cross-section of a gripper weaving machine.

The gripper weaving machine shown in FIG. 1 comprises a feed gripper 1 and a receiving gripper 2 each inserted by a rapier 3, 4 into a shed. From the weft feeding device, the feed gripper 1 carries a filling which it inserts into the shed and, at the center of the weaving machine, transfers the filling to the receiving gripper 2 which, upon its withdrawal, carries the filling to the opposite side of the shed.

The rapiers 3, 4 are actuated by drives mounted in mirror-symmetrical manner in the region of the lateral machine frame components 5. The rapiers 3, 4 are driven by a drive wheel 7 and are kept in contact with the drive wheel 7 by guide shoes 8. Typically the drive wheel 7 is a gear engaging perforations in the rapiers 3, 4 by gear teeth.

The drives 6 for the rapiers 3, 4 are synchronized by a drive 9 and drive a batten 10 supported in the lateral machine frame components 5. The batten 10 is shown in greater detail in FIG. 2 and comprises a batten fitting 11 non-rotatably affixed by screws 12 on a batten shaft 13. A reed 15 is affixed by fasteners 14 to the batten fitting 11.

An intermediate fitting 16 is affixed by screws 17 to the batten fitting 11, with guide units 19, which are mounted in a row, being fastened by screws 18 to said intermediate fitting 16. The guide units 19, in a manner described below, form guides 20 for the rapiers 3, 4 and a guide portion 21 which supports the gripper 1 or 2 and which in turn is connected to the rapier 3 or 4. These components are discussed below only for the feed gripper 1 because the design is identical for the receiving gripper 2.

Moreover the gripper weaving machine comprises means (not shown) to form sheds 22 with upperwarps 23 and lowerwarps 24. The means forming the sheds 22 are synchronized with the batten drive 9 and thereby also with the drives 6 for the rapiers 3, 4. A filling is inserted by the feed gripper 1 and the receiving gripper 2 into the opened sheds 22, and this filling then is beaten by the reed 15 against the cloth 25 through the pivoting motion of the batten 10.

The guide units 19 pivot together with the batten 10 and when a filling is beaten against the cloth 25 they will move into the position shown in dashed lines. In the maximum pivoted position of the batten 10 away from the cloth 25 as shown in FIG. 2, the guide units 19 have entered the shed 22 between the lower warps 24. In that position, the feed gripper 1 and the receiving gripper 2 are inserted into the open shed 22. The closing procedure of the shed 22 already begins after the filling has been transferred from the feed gripper 1 to the receiving gripper 2, the warps 23, 24 moving toward each other as shown in dashed lines in FIG. 3. During this closing procedure, the feed gripper 1 and the receiving gripper 2 have not yet moved completely out of the shed 22. As a result the upper warps 23 rest against the feed gripper 1 and the receiving gripper 2. The feed gripper 1 and the receiving gripper 2 are illustratively constructed in the manner of U.S. Pat. 4,860,800 and 4,708,174 and are made of a metal, in particular steel, their surfaces being smooth and polished so as to have comparatively low friction relative to the warps 23. There is relatively little danger that the upper warps 23 will be damaged by the feed gripper 1 and the receiving gripper 2, or that their position will be interfered with. To avoid damaging the lowerwarps 24 or tangling them by means of the guide portion 21, or damaging the guide surfaces of the guide portion 21 by means of the warps 24, a slide rib 26 is provided on the underside of the guide portion 21 opposite the feed gripper 1 or the receiving gripper 2 in the embodiment of FIGS. 2 and 3. This slide rib 26 is bonded into a recess of the guide portion 21, or, during the manufacture of this guide portion 21, it is shaped into it. The slide rib 26 projects sufficiently downward toward the lower warps 24 so that these warps will not come into contact with the guide portion 21 when the shed 22 is closing.

As regards the embodiment of FIGS. 2 through 5, on its side away from the reed 15, the guide portion 21 is fitted with a downward-projecting guide rib 27, running approximately over along the full length of the guide portion. A transverse guide 28 of the guide units 19 is associated with the guide rib 27 and consists of a U-shaped cross-section recess having mutually opposite side surfaces transversely guiding the side surfaces of the guide rib 27. Moreover, the guide unit 19 comprises substantially mutually parallel guides 29, 30 associated with the top and bottom sides of the rapiers 3, 4 and hence with the top side and underside of the guide portion 21 which are flush with said top and lower sides. The bottom of the U-shaped recess 28 constituting the transverse guide for the slide rib 27 is deep enough that there will be significant spacing between this bottom and the rib 26, as shown in FIGS. 2 and 3.

As shown by FIGS. 4 and 5, the feed and receiving grippers 1 and 2 resp. project forward beyond the guide portion 21. The gripper extends as far as approximately the center of the guide portion 21 and terminates obliquely at the upper side of the guide portion 21. A slide rib 31 is provided as an extension of the feed gripper 1 and projects from the upper side of the guide portion and somewhat overlaps the feed gripper 1, extending somewhat beyond the end of the guide portion 21 and then terminating obliquely in the upper side of the rapier 3, with the upper side of the band 3 being flush with the upper side of the guide portion 21.

The guide rib 27 extends along the underside approximately over the entire length of the guide portion 21. At both ends, this rib 27 terminates obliquely into the underside of the guide portion 21. The slide rib 26 inserted in the guide rib 27 extends over the full length of the guide rib 27 and slants in such a manner at both ends that it is flush with the slant of the guide rib 27.

As shown by FIG. 5, the widths of the rapier 3 and of the guide portion 21 are the same. The end of the guide portion 21 away from the gripper 1, likewise the rapier, is fitted with a recess whereby the rapier 3 and the guide portion 21 overlap approximately over half the length of the guide portion in the area of this recess. The guide portion 21 and the rapier 3 are affixed to each other in this area.

As regards the embodiment of FIGS. 6 and 7, the guide portion 21 corresponds in its design to that of FIG. 3 and is fitted with a further slide rib 32 in the region of its side edge facing the reed 15. This slide rib 32 only runs approximately over the front half of the guide portion 21, merges by a slanted section into the underside of the quick portion, and permits reduction somewhat of the height of the slide rib 26 without the warps 24 coming into contact with the guide portion 21 when the shed is being closed. Moreover, the shed 22 may be closed even earlier before the feed gripper 1 is withdrawn from the shed 22 without the warps 24 touching the edge of the guide portion 21 facing the reed 15.

As regards the embodiment of FIGS. 8 and 9, a guide portion 33 is used which also is fitted with a downward-projecting guide rib 34 on its side facing the reed 15. Accordingly the transverse guidance of the this guide portion 33 is carried out between two guides 35, 36 of the guide unit 19 which run perpendicularly to the guide 29. The U-shaped recess 28 of the guide units 19 in this instance is somewhat wider than the guide rib 27.

Both guide ribs 27, 34 of the embodiment of FIGS. 8 and 9 are fitted with slide ribs 26, 37 which project downward equally. The slide rib 37 of the guide rib 34 however runs approximately only over the front half of the guide portion 33.

As regards the embodiment of FIGS. 10 and 11, in a manner similar to the design of FIGS. 8 and 9, the guide portion includes guide ribs 27, 34 on its underside. These guide ribs 27 are fitted with slide ribs 38, 39 projecting beyond the guide portion 33 and extending as far as the beginning zone of the rapier 3. They are fitted with oblique risers inserted into recesses of the rapier 3. This feature ensures that warps will not snag at the transition between the guide portion 33 and the rapier but instead will be safely guided across this transition zone.

The guide portion 21 or 33 is made of a plastic which shall present the least possible sliding friction to the metallic guide units 19. The slide ribs 26, 32, 37, 38, 39 and 31 are made of a wear-resistant material having minimal friction relative to the warps 24. Preferably they will be metallic, in particular being made of steel and have a polished surface. The edges coming in contact with the warps 24 are rounded. The slide ribs 26, 32, 37, 38, 39 and 31 may be surface-treated to increase their wear resistance and/or to reduce the friction relative to the warps 24. Illustratively they may be hardened or be coated. In another design the slide ribs 26, 32, 37, 38, 39 and 31 are non-metallic, for example, made of ceramics.

What is claimed is:

1. A gripper weaving machine comprising:

a guide portion having upper and lower sides, the guide portion connected to a rapier;

at least one gripper positioned at the upper side of the guide portion;

a plurality of guides arranged to guide the rapier and the guide portion, the guides comprising a plurality of guide units arranged in a row and insertable into a formed shed; and the guide portion comprising at least one slide rib of wear-resistant material, the at least one slide rib positioned at the lower side of the guide portion, facing away from the gripper and extending in a longitudinal and downward direction of the guide portion, such that the at least one slide rib prevents warps from contacting the lower side of the guide portion.

2. The gripper weaving machine as claimed in claim 1, wherein at least one slide rib joins the gripper in a longitudinal direction of the rapier at the guide portion and/or the gripper.

3. The gripper weaving machine as claimed in claim 2, wherein the slide rib and the gripper mutually overlap in the longitudinal direction of the rapier.

4. The gripper weaving machine as claimed in claim 1, wherein one or more of the slide ribs comprise slanted end sections that merge into the guide portion.

5. The gripper weaving machine as claimed in claim 1, wherein the guide portion comprises at least one guide rib associated with a transverse guide of the guide units and the at least one slide rib projects from the guide rib on its side facing away from the gripper.

6. The gripper weaving machine as claimed in claim 1, wherein the guide portion is fitted on its side facing away from the gripper with one of the slide ribs positioned in the region of the side edges of the guide portion.

7. The gripper weaving machine as claimed in claim 1, wherein the guide portion is plastic.

8. The gripper weaving machine as claimed in claim 1, wherein at least one of the slide ribs is fitted with a smooth, wear-resistant surface.

9. The gripper weaving machine as claimed in claim 8, wherein at least one of the slide ribs is made of metal.

10. The gripper weaving machine as claimed in claim 9, wherein at least one of the slide ribs has a surface treatment.

11. The gripper weaving machine as claimed in claim 9, wherein at least one of the slide ribs is made of steel.

* * * * *